US005324883A

United States Patent [19]

Kondo

[11] Patent Number: 5,324,883

[45] Date of Patent: Jun. 28, 1994

[54] METHOD AND DEVICE FOR PREVENTING IMBALANCE OF SOUND EMISSIONS IN AN AUTOMATIC PERFORMING PIANO

[75] Inventor: Tetsusai Kondo, Hamamatsu, Japan

[73] Assignee: Kabushiki Kaisha Kawai Gakki Seisakusho, Japan

[21] Appl. No.: 904,745

[22] Filed: Jun. 26, 1992

[30] Foreign Application Priority Data

Jun. 26, 1991 [JP] Japan ..... 3-154961
Jun. 27, 1991 [JP] Japan ..... 3-157027

[51] Int. Cl.[5] ..... G10H 7/00; G10H 1/18

[52] U.S. Cl. ..... 84/615; 84/609; 84/23

[58] Field of Search ..... 84/19-23, 84/615, 618, 626, 609

[56] References Cited

U.S. PATENT DOCUMENTS

| | | | |
|---|---|---|---|
| 4,132,141 | 1/1979 | Campbell et al. . | |
| 4,567,804 | 2/1986 | Sawase et al. | 84/462 X |
| 4,593,592 | 6/1986 | Stahnke | 84/21 |
| 4,744,281 | 5/1988 | Isozaki | 84/171 X |
| 4,913,026 | 4/1990 | Kaneko et al. | 84/21 |
| 4,970,928 | 11/1990 | Tamaki | 84/21 |
| 5,016,513 | 5/1991 | Stahnke | 84/19 |
| 5,022,301 | 6/1991 | Stahnke | 84/21 |
| 5,072,644 | 12/1991 | Isozaki et al. | 84/609 |
| 5,083,491 | 1/1992 | Fields | 84/21 |
| 5,164,532 | 11/1992 | Ishii et al. | 84/639 |

FOREIGN PATENT DOCUMENTS

| | | |
|---|---|---|
| 53-20315 | 2/1978 | Japan . |
| 53-102020 | 9/1978 | Japan . |
| 55-84088 | 6/1980 | Japan . |
| 58-18691 | 2/1983 | Japan . |
| 58-179894 | 10/1983 | Japan . |
| 61-128295 | 6/1986 | Japan . |
| 63-37395 | 2/1988 | Japan . |
| 63-217908 | 8/1988 | Japan . |
| 63-44867 | 11/1988 | Japan . |
| 63-301997 | 12/1988 | Japan . |
| 64-44936 | 2/1989 | Japan . |
| 64-247666 | 9/1989 | Japan . |
| 64-291944 | 11/1989 | Japan . |
| 1-332912 | 12/1989 | Japan . |
| 2164192 | 3/1986 | United Kingdom . |
| WO80/02886 | 12/1980 | World Int. Prop. O. . |

*Primary Examiner*—William M. Shoop, Jr.
*Assistant Examiner*—Jeffrey W. Donels
*Attorney, Agent, or Firm*—Davis, Bujold & Streck

[57] ABSTRACT

A recording/reproducing method and device for an automatic performing piano which not only seizes performance information according to occurrence and timing of an on-event, but also converts the performance information according to actual emission timing in each respective recording and reproducing process steps, thereby achieving accurate performance reproduction with balance and high fidelity. Since a time lag between depression of key and emission of sound varies with the intensity in depressing of the keys, this time lag is incorporated into performance information to be stored, a key drive solenoid can be actuated or terminated in immediate response to the output of key depression or release data, respectively.

13 Claims, 17 Drawing Sheets

Fig.7

| TDrec | KNo. | Pon | UNOCCUPIED |
|---|---|---|---|
| 01h(5msec) | 20h | 75h | |
| 02h(10msec) | 22h | 2Fh | |
| 07h(35msec) | 34h | 0Fh | |
| 03h(15msec) | 36h | 22h | |
| | | | |

Fig.10

| TDplay | KNo. | Pon | UNOCCUPIED |
|---|---|---|---|
| 0Eh(70msec) | 20h | 75h | |
| 05h(25msec) | 22h | 2Fh | |
| 03h(15msec) | 34h | 0Fh | |
| | | | |

PRIOR ART

METHOD AND DEVICE FOR PREVENTING IMBALANCE OF SOUND EMISSIONS IN AN AUTOMATIC PERFORMING PIANO

BACKGROUND OF THE INVENTION

This invention relates to a recording/reproducing method and device for controlling sound emission for an automatic performing piano, and more specifically to such a piano which is immune from inaccuracy of performance in sound reproduction due to the time lag of emission of sound caused by variations in intensity of depressed keys.

A conventional automatic performing piano has suffered from imbalance of sound emission timing between strong key strokes and weak key strokes. This is due to the time period from a depress-key command (on-event) to actual emission of sound during which a solenoid is energized.

Some prior art methods try to solve this problem by adopting a sound prohibited time period $T_1$, as shown in FIG. 11, in designing the value of electric power $L_{drv}$ to be supplied to the solenoid for the depressed keys. In the figure, $L_1$ is an original voltage level, $L_2$ is a start-up voltage level, and $L_3$ is a holding voltage level. $T_2$ is a time period to sustain the start-up voltage level. The sound prohibited time period $T_1$ is provided at the first stage of the application of electric power $L_{drv}$ in order to correct emission timing. The sound prohibited time period $T_1$ is determined according to depression intensity data included in depression data, such that the stronger the key stroke is, the longer the duration of the sound prohibited time period $T_1$. The maximum value of the sound prohibited time period $T_1$ is 100 milliseconds.

In formulating or formatting recorded performance information to be later reproduced, the prior art methods and devices define the occurrence of an on-event and off-event as the timing of depression and release of a key, respectively, which are detected by key sensors 7 and 8 shown in FIG. 3. However, this method suffers from the following problem.

Since hammer systems and other mechanisms respond to strong key strokes more quickly than to weak key strokes as shown in FIG. 12A and FIG. 12B, a time period of emission delay in recording $TD_{rec\text{-}on}$, which is the time lag between occurrence of an on-event $t_{on}$ and actual sound emission $t_{music}$, shortens as the key stroke intensifies. Therefore, in recording an original performance by a performer, simultaneous occurrence of an on-event for a strong key stroke and a weak key stroke must be interpreted in actual sound emission as a strong key stroke followed by a weak key stroke as shown in FIG. 12C to reproduce the performance with fidelity and accuracy. The prior art method and device thus fails to reproduce performance with high fidelity and accuracy because of the definition of an on-event and an off-event as the actual timing of depression and release of key, respectively.

Moreover, the following problem occurs in determining the sound prohibited time period $T_1$ simply according to depression intensity in designing a chart or amount of electric power $L_{drv}$ for the performance information thus recorded. Since recording is executed according to the occurrence timing of on-event shown in the graph of FIG. 13, but not to the actual and acoustic or sound emission timing shown in the second graph of FIG. 13, the recorded interval of emission $INT_{rec}$ between a strong key stroke and an immediately following weak key stroke is shorter than the actual interval of emission $INT_{act}$.

Further, by providing the sound prohibited time period $T_1$ again in the sound reproduction steps, the reproduced interval of emission between the two key strokes is further shortened as shown in the fourth and fifth graphs of FIG. 13. Consequently, the time period for holding emission of the former of two successive key strokes may be corroded and shortened by the sound prohibited time period $T_1$ for the latter, occasionally resulting in failure to reproduce the sound for the former key stroke.

SUMMARY OF THE INVENTION

Wherefore, an object of this invention is to provide a recording/reproducing method and device for an automatic performing piano which not only seizes performance information according to occurrence timing of an on-event, but also converts the performance information according to actual emission timing in each recording and reproducing process step, thereby reproducing the performance with balance and high fidelity.

In order to achieve the above object, the recording method of this invention includes steps S1–S3 shown in FIG. 1. In step S1, key depression data and key release data are formulated according to detected depression or release of a key and the traveling speed of the key being depressed and released. In step S2, a time lag between depression of a key and emission of sound in recording is incorporated into the depression data and the release data. The time lag varies with the travel speed of the keys. In step S3, the depression data and the release data are stored as performance information in sequence according to the sequence of the performance.

The reproducing method according to this invention includes steps S4–S6 shown also in FIG. 1. In step S4, a time lag between depression of a key and emission of sound in reproduction is incorporated into the performance information. The time lag varies according to the depression intensity included in the depression data. In step S5, the depression data and the release data are output according to the sequence of the performance. In step S6, a solenoid is immediately actuated or its actuation terminated according to the depression data or the release data, respectively. The solenoid is driven by electric power having a value determined according to the depression intensity included in the depression data.

According to the recording/reproducing method of this invention, correct timing can be provided for sound emission and sound cessation both during recording and reproduction. This is accomplished by incorporating the time lag between the depression of a key and emission of sound during both the recording and reproduction process steps. A further feature is the adoption of a unique method wherein a solenoid is actuated or its actuation terminated in immediate response to an on-event command or an off-event command, respectively.

Either of the recording method and the reproducing method of the present invention may be independently used according to the respective specified present method.

The reproducing device according to this invention comprises, as shown in FIG. 2, performance information storing means M1, depression/release timing detection means M2, depression intensity calculation means M3, performance information formulation means M4, performance information output means M5, and solenoid drive means M6. The performance information storing means M1 stores the key depression data and the key release data in turn as performance information. The depression/release timing detection means M2 detects the timing of depression and release of a key according to the distance the key traveled in being depressed or released. The depression intensity calculation means M3 calculates the depression intensity according to the traveling speed of the key being depressed. The performance information formulation means M4 formulates performance information comprising the depression data and the release data according to the timing of key depression or release detected, and the depression intensity calculated, and provides the performance information storing means M1 with the key depression data and the key release data in sequence along the performance. The performance information output means M5 outputs the key depression data and the key release data stored in the performance information storing means M1 in sequence to reproduce the performance. The solenoid drive means M6 actuates a solenoid by means of electric power having a value which is determined according to the depression intensity comprised in the key depression data, and terminates the electric power to the solenoid in response to the key release data.

The performance information formulation means M4 according to one aspect of this invention comprises a first incorporation means M7, a first temporary storing means M8, and a first timing means M9. The first incorporation means M7 incorporates sound emission delay in recording into the key depression data and the key release data. The delay of sound emission is a time lag between depression of a key and actual sound emission, and varies with key depression intensity. The first temporary storing means M8 temporarily stores the key depression data and the key release data with the delay of emission in recording incorporated therein. The first timing means M9 arranges the timing to send out the key depression data and the key release data to the performance information storing means M1 after the expiration of the time period of the emission delay in recording which is incorporated in the key depression and release data.

The performance information output means M5 according to another aspect of this invention comprises a second incorporation means M10, a second temporary storing means M11, and a second timing means M12. The second incorporation means M10 incorporates delay of sound emission in reproduction into the key depression data and the key release data read out from the performance information memory means M1. The emission delay in reproduction is a time lag between depression of key and emission of sound in reproduction, and varies with the key depression intensity. The second temporary storing means M11 temporarily stores the key depression data and the key release data with the emission delay in reproduction incorporated therein. The second timing means M12 arranges the timing to send out the key depression data and the key release data stored within the second temporary storing means M11 to the solenoid drive means M6 after the expiration of the time period of the emission delay in reproduction incorporated in the key depression and the key release data. Once given the key depression data or the key release data, the solenoid drive means M6 is driven or terminated in immediate response.

BRIEF DESCRIPTION OF THE DRAWINGS

FIG. 7 is a table illustrating the contents of a temporary memory during the recording process steps;

FIG. 10 is a table representing the contents of the temporary memory during reproduction process;

DETAILED DESCRIPTION OF THE PREFERRED EMBODIMENT

An embodiment of the recording/reproducing method and device for an automatic performing piano according to the present invention will now be explained hereunder.

Figure 1:
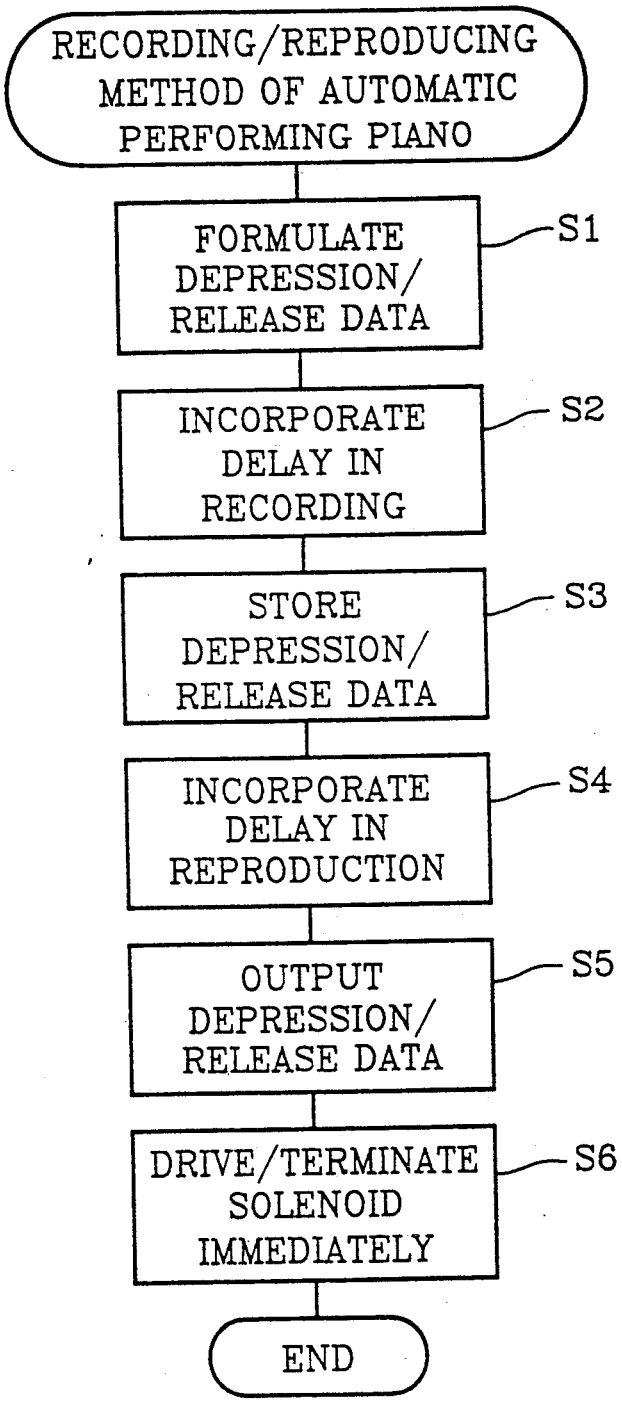
FIG. 1 is a fowchart to exemplifying a recording/reproducing method according to the present invention.
Figure 2:
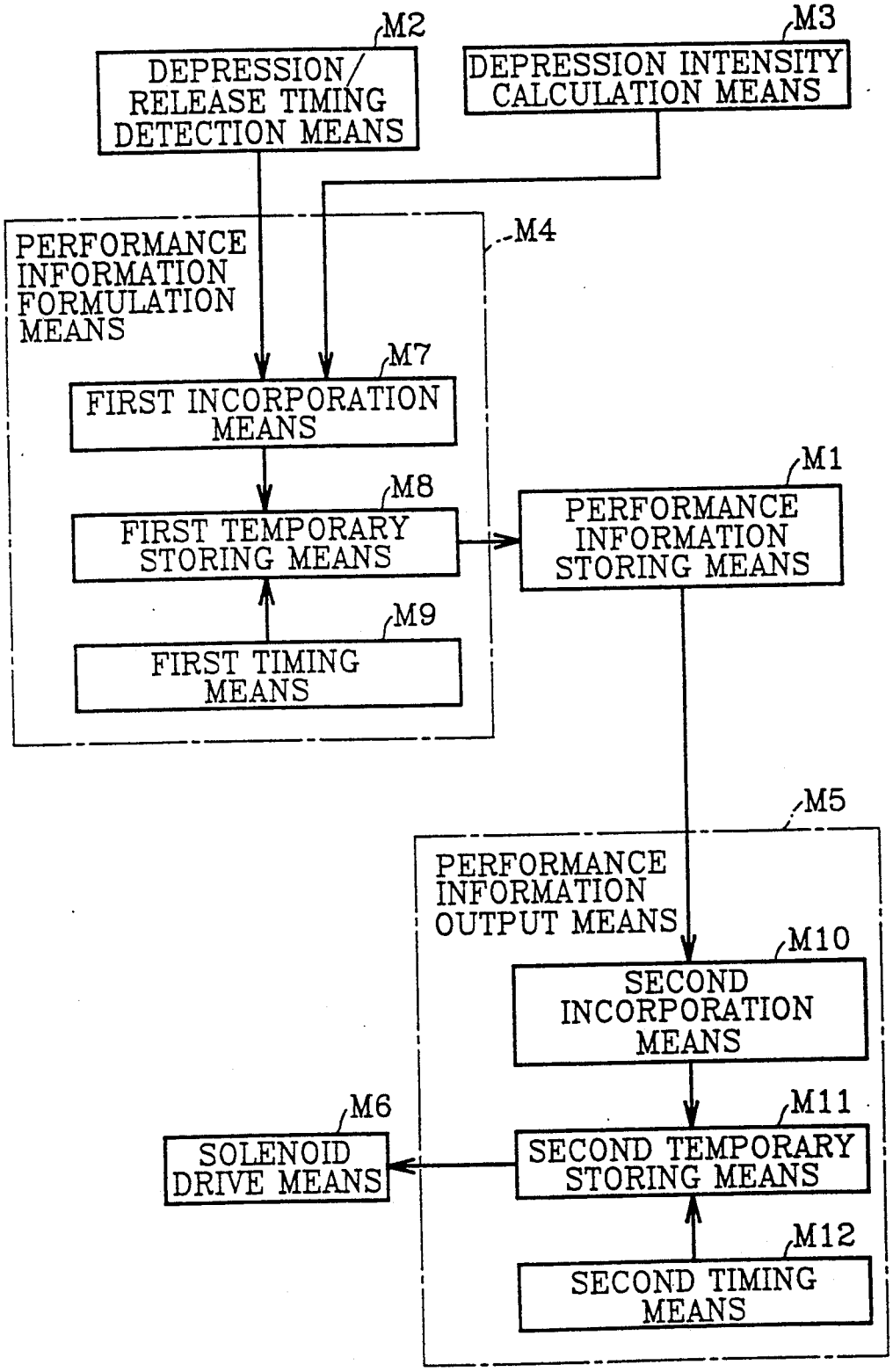
FIG. 2 is a block diagram showing the structure of a recording/reproducing device according to the present invention.
Figure 3:
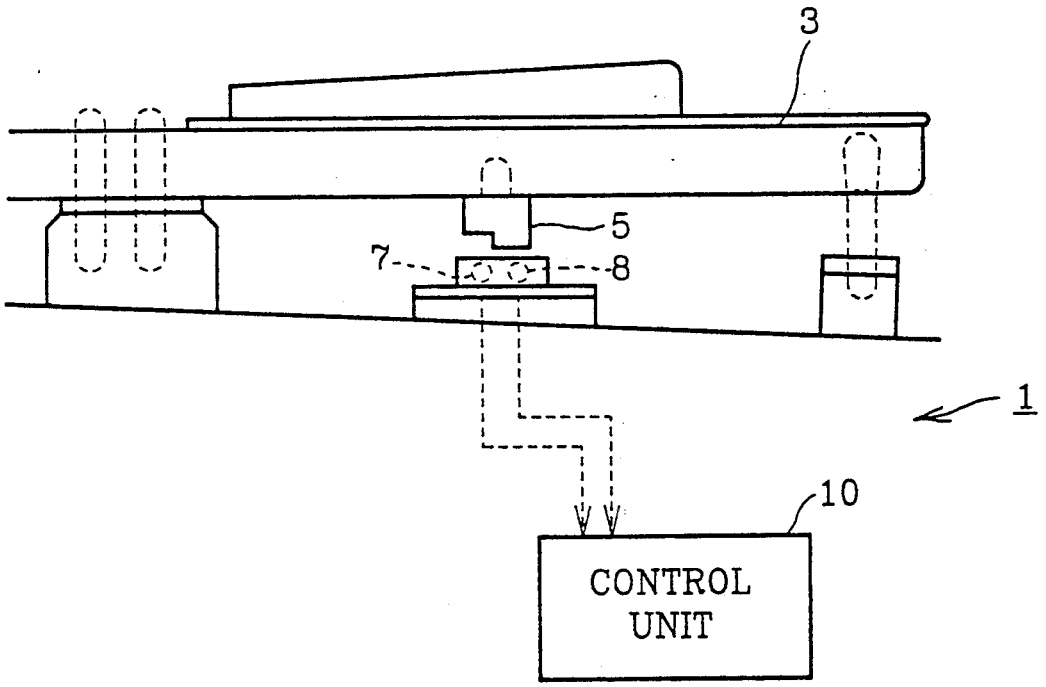
FIG. 3 is a cross sectional schematic view showing a piano key and the sensors for measuring the depression intensity according to one embodiment of this invention.

An automatic performing piano 1, FIG. 3, of one embodiment is provided with stepped shutters 5 bellow keys 3, and control unit 10. Below each of the keys 3 is located key sensors 7 and 8, each comprising a light emitting element and a light receiving element. The control unit 10 detects the time and the time lag when the stepped shutters 5 are intermediate or between either or both the key sensors 7 and the key sensors 8 thus blocking the light path. The control unit 10 formulates performance information including key number, timing of depression of a key, timing of release of a key, and depression intensity.

Figure 4:
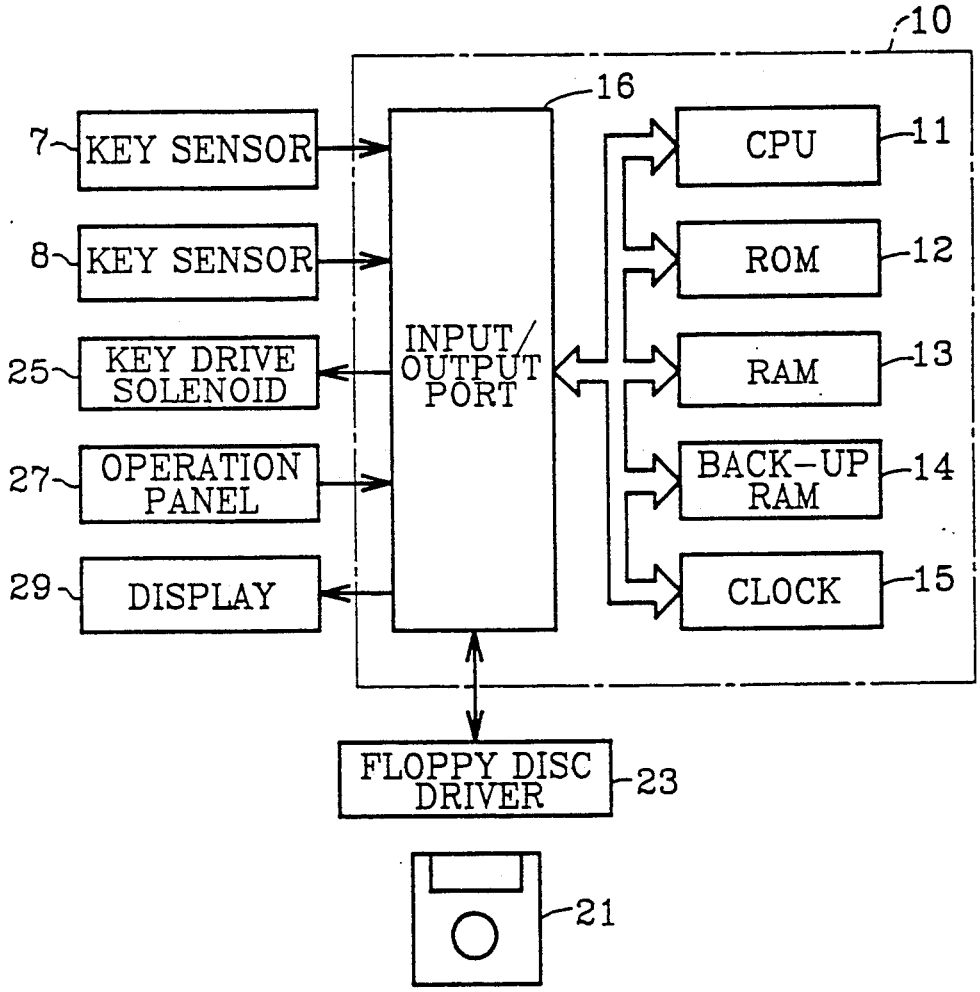
FIG. 4 is a block diagram showing the relation between a control unit and other elements of an automatic piano.

Each of the control units 10, FIG. 4, includes a CPU 11, ROM 12, RAM 13, back-up RAM 14, and a clock 15. Control unit 10 is connected to the key sensors 7 and 8 via an input/output port 16. The control units 10 are also connected to floppy disc drivers 23, solenoids 25, an operation panel 27, and a display 29 via the input-/output port 16. The floppy disc drivers 23 control floppy discs 21 storing performance information. The solenoids 25 drive keys 3 during an automatic reproduction of performance. The operation panel 27 is provided for selecting an operation mode such as recording, reproducing (playback), or other similar modes.

Figure 5A:
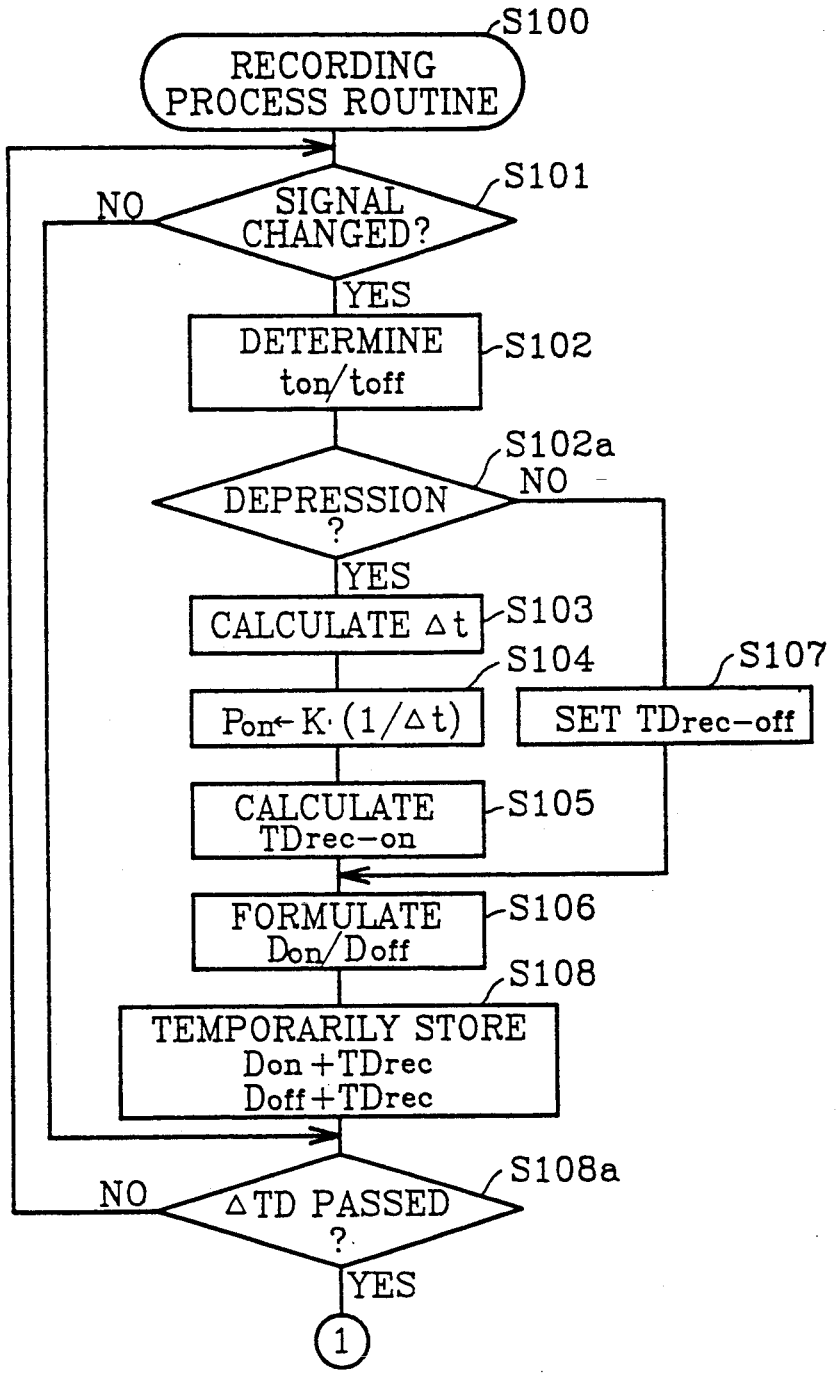
FIGS. 5A and 5B taken together are a flowchart of the recording process of one embodiment according to the present invention.
Figure 5B:
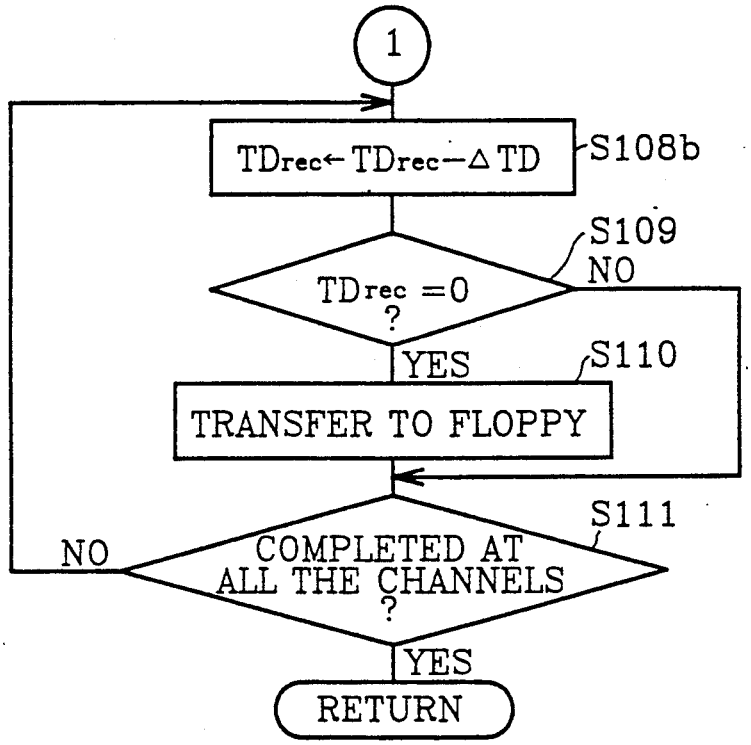

The above hardware structure is in common with the prior art devices. The present automatic performing piano according to one embodiment is characteristic in recording a performance as shown in the steps specified in FIGS. 5 and 5B.

This process starts, S100, when the recording mode is selected on the operation panel 27. In this embodiment, recording and reproduction modes are conducted according to the so called "event method".

It is first examined whether the signals from the key sensors 7 and 8 (though shown in FIG. 3 is for a single key, key sensors 7 and 8 are provided for all the eighty-eight keys) have changed in response to the depression or release of a key, step S101. If the signals have changed, the timing $t_{on}$ at which an on-event (key depression) occurred, or the timing $t_{off}$ (key release) at which off-event occurred is determined by the detected value of the key sensors 7 and 8, S102. Specifically, the timing $t_{on}$ is determined by the timing when the value of a key sensor 7 changes from "on" to "off", and the timing $t_{off}$ is determined by the timing when the value of a key sensor 8 changes from "off" to "on".

Subsequently, it is examined whether the change of signals is due to the depression of a key, S102*a*. If the timing $t_{on}$ was detected at S102, depression is detected. Then a time lag $\Delta t$ between the timing when the value of the key sensors 8 changed from "on" to "off" and the timing when the value of the key sensors 7 changed from "on" to "off" is calculated (S103).

Next, depression intensity data $P_{on}$ is calculated according to the time lag $\Delta t$, S104. In the figure, K is a coefficient for logical operation, and is predetermined according to the location and the size of the shutters 5 and other factors. A time period of emission delay in recording, $TD_{rec\text{-}on}$, is then calculated according to the depression intensity data $P_{on}$, S105. The emission delay in recording is due to the traveling speed of the keys 3 which causes a time lag between the occurrence of an on-event and the actual emission of sound, and is a result of the mechanical driving of the hammer systems.

Depression data $D_{on}$ is then formulated by combining the depression intensity data $P_{on}$, the key number, and the occurrence timing of the on-event $t_{on}$, S106.

If, however, it is determined in S102*a* that the signal change is due to release of a key, a time delay period of cessation in recording, $TD_{rec\text{-}off}$, which is a time lag between the occurrence and timing of the off-event, $t_{off}$, and the actual timing of cessation of sound is determined S107.

Subsequently, release data $D_{off}$ is formulated by combining the occurrence timing of off-event $T_{off}$, key number, and depression intensity data $P_{on}$, S106 in the same manner as in formulating depression data $D_{on}$. The depression intensity data $P_{on}$ for the release data $D_{off}$ is zero in general.

The depression data $D_{on}$ thus prepared is then combined with the emission delay in recording, $TD_{rec\text{-}on}$, to become a set of performance information data $D_{on}+TD_{rec}$. On the other hand, the release data $D_{off}$ is combined with the cessation delay in recording $TD_{rec\text{-}off}$ to become another set of performance information data $D_{off}+TD_{rec}$. The performance information data $D_{on}+TD_{rec}$ or the performance information data $D_{off}+TD_{rec}$ is temporarily stored in an unoccupied channel of an assigner specifically provided for recording within the RAM 13, S108. In this embodiment, one assigner comprises sixty-four channels.

Figure 6:
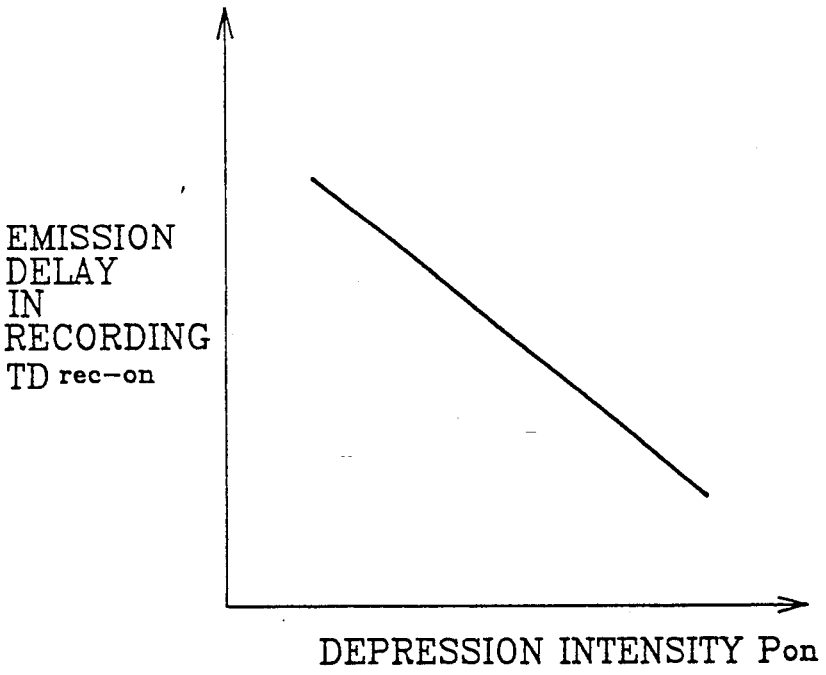
FIG. 6 is a graph showing an example of map data referred to in the present recording process.

Since the time period of emission delay in recording $TD_{rec\text{-}on}$ is a time lag between occurrence and timing of an on-event detected in response to depression of a key by a performer and actual emission of sound, the time period becomes longer as the depression intensity $P_{on}$ diminishes, within the range of several milliseconds to 100 milliseconds as shown in FIG. 6. In this embodiment, the emission delay in recording $TD_{rec\text{-}on}$ is actually derived using the depression intensity data $P_{on}$, mapped out within the ROM 12, given the actual depression intensity data $P_{on}$ calculated at step S103, and assigned a specific value through interpolation or other similar means.

On the other hand, the time delay period of cessation in recording, $TD_{rec\text{-}on}$, in this embodiment is preset at 35 milliseconds which is a representative value of the traveling speed of the keys 3 in response to release of a key. The traveling speed varies according to the mechanical characteristics of the keys 3 and other moving members or parts.

In a highly skilled performance, keys may be slowly released intentionally. In order to reproduce the performance, so called "off-velocity" is calculated in the same manner as at steps S102–S105 according to the time lag between the detected values of the key sensors 7 and 8 in changing from "off" to "on". The relation between the off-velocity and cessation delay in recording $TD_{rec\text{-}off}$ may be mapped out such that as the off-velocity decreases, the time delay period of cessation in recording $TD_{rec\text{-}off}$ lengthens. The time delay period of cessation in recording $TD_{rec\text{-}off}$ can be calculated according to this mapped out relation between the off-velocity and the cessation delay in recording $TD_{rec\text{-}off}$.

As a result of the process step at step S108, the RAM 13 stores, in hexadecimal notation, recording delay data $TD_{rec}$ at a first byte, key number data $K_{No}$, at a second byte, and depression intensity data $P_{on}$ at a third byte as shown in FIG. 7. Although the figure shows only key depression data $D_{on}$, the key release data $D_{off}$ is stored in the same manner.

Subsequently, the present method examines whether a certain short time period $\Delta TD$ (5 milliseconds in this embodiment) has passed, S108*a*. If not, the process returns to step S101. If it is determined to be "NO" at step S101, the process proceeds directly to step S108*a*, skipping steps S102–S108.

If it is determined to be "YES" at step S108*a*, the short time period $\Delta TD$ is subtracted from the recording delay data $TD_{rec}$ temporarily stored at the channel which is to be processed firstly among the other channels within the assigner for recording, S108*b*. It is then examined whether the recording delay data $TD_{rec}$ after the subtraction is 0 milliseconds, S109. If so, the information is stored as performance information on the floppy disc 21, S110. Subsequently, it is examined whether the process steps at S108 and S109 are completed for all the channels, S111. If there is any channel for which the process steps have not been completed, the predetermined value $\Delta TD$ is subtracted from the recording delay data $TD_{rec}$ of the channel, S108*b*, and then steps beginning at steps S109 and thereafter are repeated. If it is determined to be "NO" at step S109, the process proceeds to step S111, skipping step S110.

According to the recording method thus conducted, the balance between emission timing and cessation timing of actual performance can be maintained in recording. Specifically, occurrence timing of an on-event $t_{on}$ and of an off-event $t_{off}$ are not only seized according to mechanical operation, but are corrected to be performance information reflecting actual timing of sound emission and of cessation in emission.

Figure 8A:
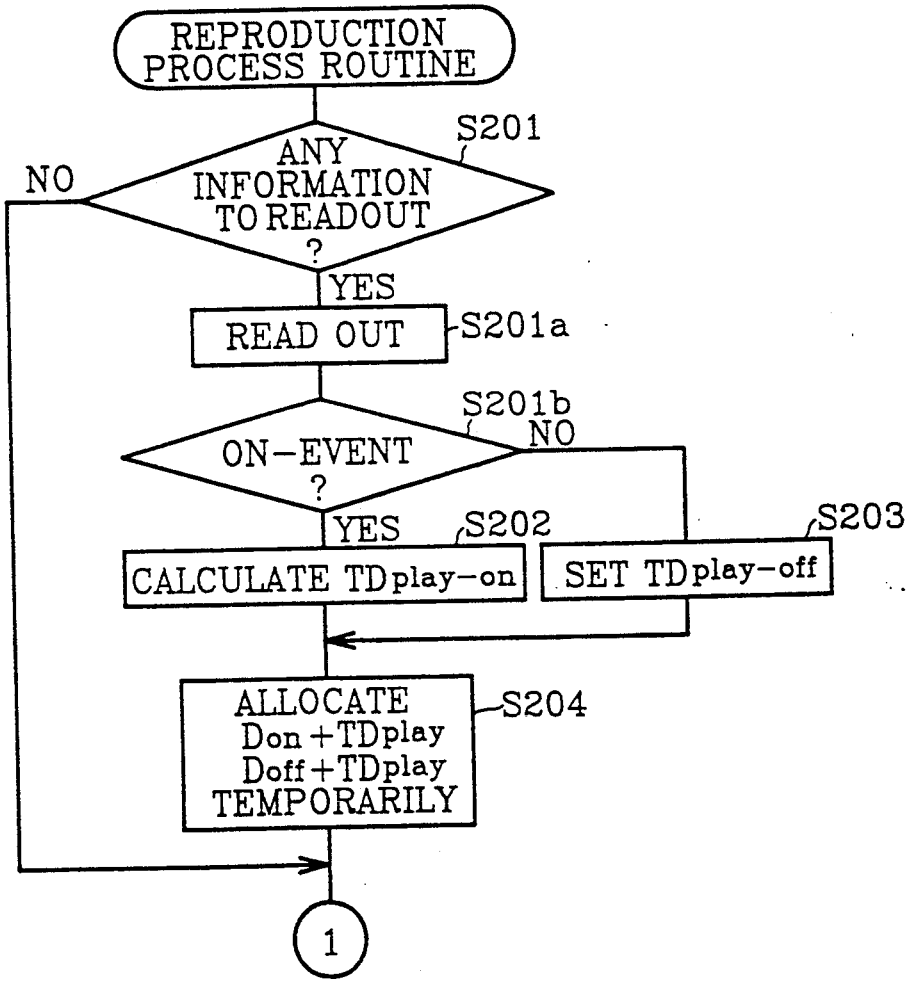
FIGS. 8A and 8B taken together are a flowchart of the reproduction process of another embodiment according to the present invention.
Figure 8B:
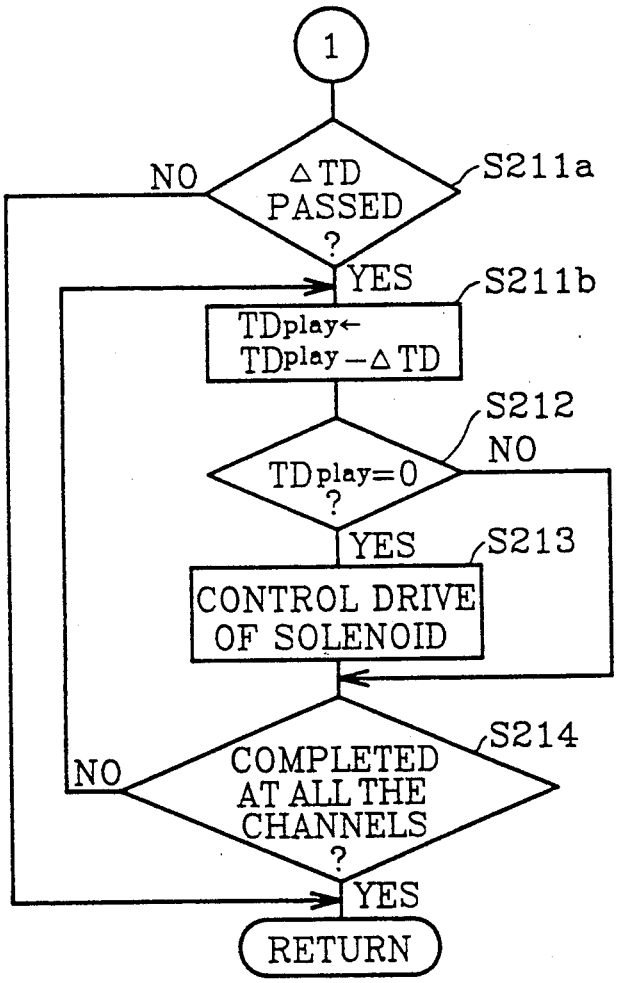

The reproducing method according to another embodiment of this invention begins by selecting reproduction mode on the operation panel 27 and proceeds as shown in FIGS. 8A and 8B.

It is first examined whether there is any performance information to be read out from the floppy disc 21, S201. Specifically, by determining from the performance information the sequence of the depression data $D_{on}$ and the release data $D_{off}$, it is determined whether to read out either of the depression data, $D_{on}$, and the release data, $D_{off}$. Since an event method is also adopted in this reproduction process, the characteristics of depression data $D_{on}$ and release data $D_{off}$ are independent from each other.

The performance information to be read out, if any, is read out from the floppy disc 21, S201*a*, and whether the information was caused by an on-event is determined, S201*b*. If the information was caused by on-event, i.e. the information is depression data $D_{on}$, a time period of sound emission delay in reproduction $TD_{play\text{-}on}$ is calculated according to the depression intensity data $P_{on}$, S202. On the other hand, if the performance information read out is release data $D_{off}$, time delay period of cessation in reproduction $TD_{play\text{-}off}$ is set, S203. The time period of sound emission delay in reproduction $TD_{play\text{-}on}$ calculated is added to depression data $D_{on}$ to formulate performance information data $D_{on}+TD_{play}$. Alternatively, the time delay period of cessation in reproduction $TD_{play\text{-}off}$ is added to the release data $D_{off}$ to formulate $D_{off}+TD_{play}$. The performance information data $D_{on}+TD_{play}$ or $D_{off}+TD_{play}$ is temporarily allocated at an unoccupied channel of an assigner for reproduction within the RAM 13, S204. The assigner for the reproduction mode also comprises sixty-four channels.

Figure 9:
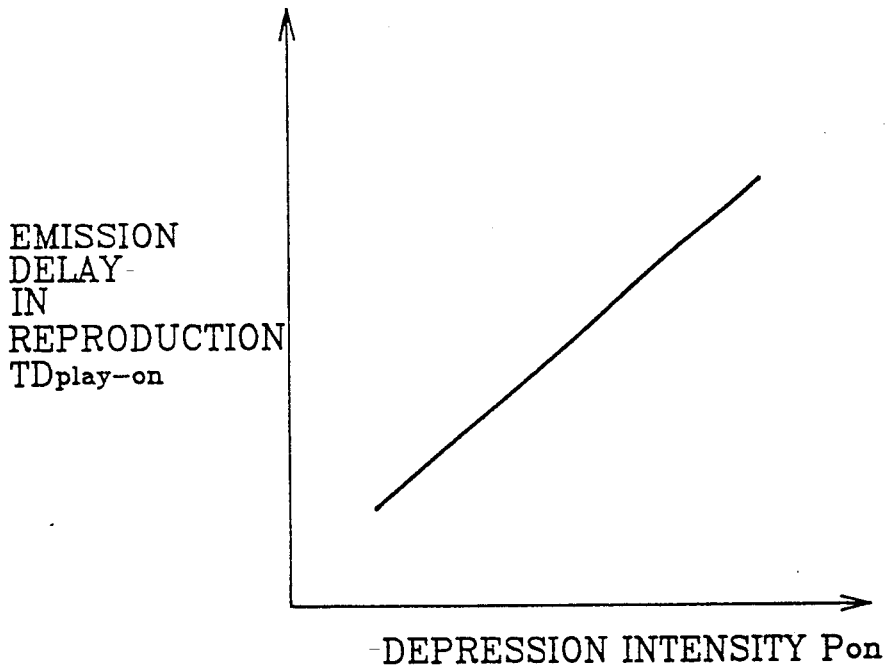
FIG. 9 is a graph representing an example of the mapped data referred to in the present reproduction process steps.
Figure 11:
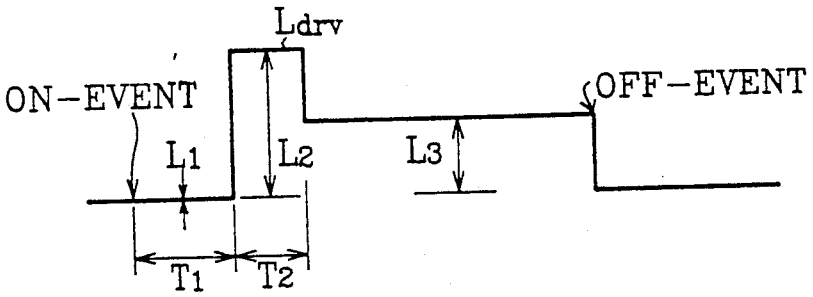
FIG. 11 is an example of a time diagram adopted in the prior art reproducing method.
Figure 12A:
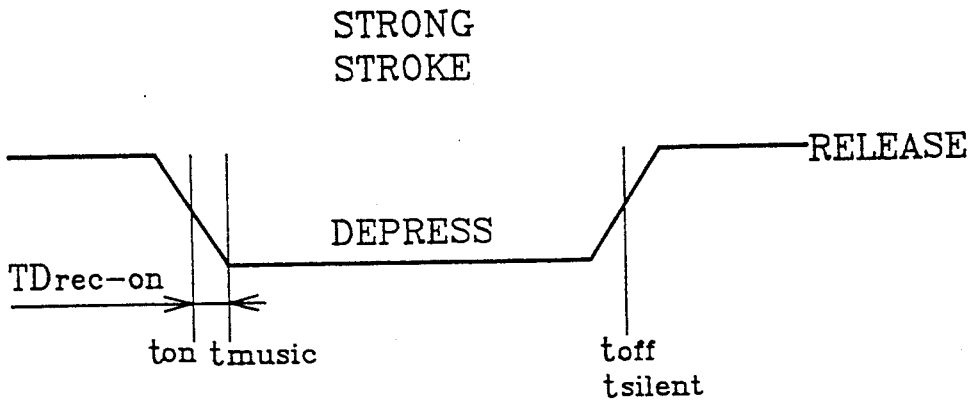
FIGS. 12A, 12B, and 12C are timing diagram illustrating the problems inherent in the prior art recording method.
Figure 12B:
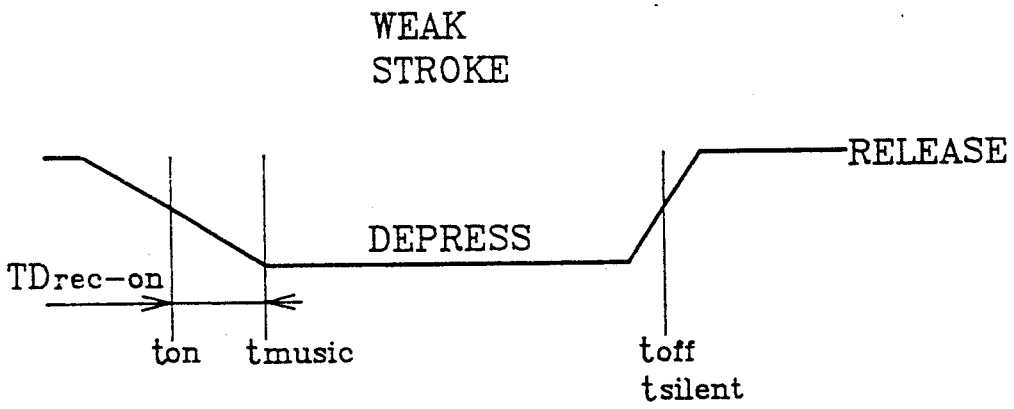
Figure 12C:
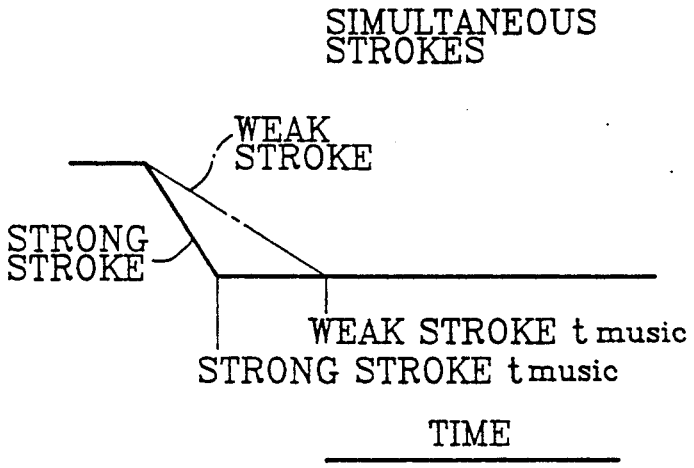

As shown in FIG. 9, as depression intensity data $P_{on}$ increases, the time period of emission delay in reproduction $TD_{play\text{-}on}$ lengthens within the range from several milliseconds to 100 milliseconds. Therefore, the sound emission delay in reproduction $TD_{play\text{-}on}$ is also derived utilizing the depression intensity $P_{on}$, mapped out within the ROM 12, given the actual depression intensity data $P_{on}$, and assigned a specific value through interpolation or other similar methods. On the other hand, the time delay period of cessation in reproduction is set at 35 milliseconds which is a representative value of the traveling speed of the keys 3. The traveling speed of the keys 3 depends on the mechanical characteristics of the keys 3 and other moving or active members. Therefore, the value of the time delay period of cessation in reproduction $TD_{play\text{-}off}$ may be varied by incorporating the calculated off-velocity of the keys.

As a result of the process step at step S204, each channel of the assigner for reproduction within the RAM 13 stores, in hexadecimal notation, reproduction delay data $TD_{play}$ at a first byte, key number $K_{No.}$ at a second byte, and depression intensity data $P_{on}$ at a third byte as shown in FIG. 10. Although the figure shows only the key depression data $D_{on}$, the key release data $D_{off}$ is stored in the same manner.

Subsequently, it is examined at step S211*a* if a short time period ΔTD (5 milliseconds in this embodiment) has passed, S211*a*. If it is determined to be "NO", the process returns to step S201. If a "NO" is determined at S201, the process proceeds directly to step S211*a*, skipping the process steps therebetween.

If a "YES" is determined at step S211*a*, the short time period ΔTD is subtracted from the reproduction delay data $TD_{play}$ temporarily allocated to the channel which is to be processed first among the other channels within the assigner for reproduction, S211*b*. Then it is examined if there is any reproduction delay data $TD_{play}$ which has become 0 milliseconds due to the subtraction, S212.

If it is determined to be "YES" at the step S212, a key solenoid is driven or its driving voltage terminated according to either the depression data $D_{on}$ or the release data $D_{off}$ combined with the reproduction delay data $TD_{play}$ which has become 0 milliseconds, S213. Subsequently, it is examined whether the process at step S211*b* and thereafter are completed for all the channels of the assigner for reproduction, S214. If there is any channel for which the process is not complete, the short time period ΔTD is subtracted from the reproduction delay data $TD_{play}$ of the performance information temporarily allocated at the given channel, S211*b*, and steps S212 and thereafter are repeated. If it is determined to be "NO" at step S212, the process proceeds to step S214, skipping the process at step S213.

Thus the solenoid is driven or terminated favorably reflecting the actual desired timing of sound emission and cessation, in direct response to the performance information. Specifically, since occurrence timing of an on-event $t_{on}$ and occurrence timing of an off-event $t_{off}$ are output according to actual emission timing, the circuit driving the solenoid need not calculate a delay or sound prohibited time period. Therefore, the solenoid can be immediately driven or its activation terminated in direct response to an on-event or an off-event, respectively.

Figure 13:
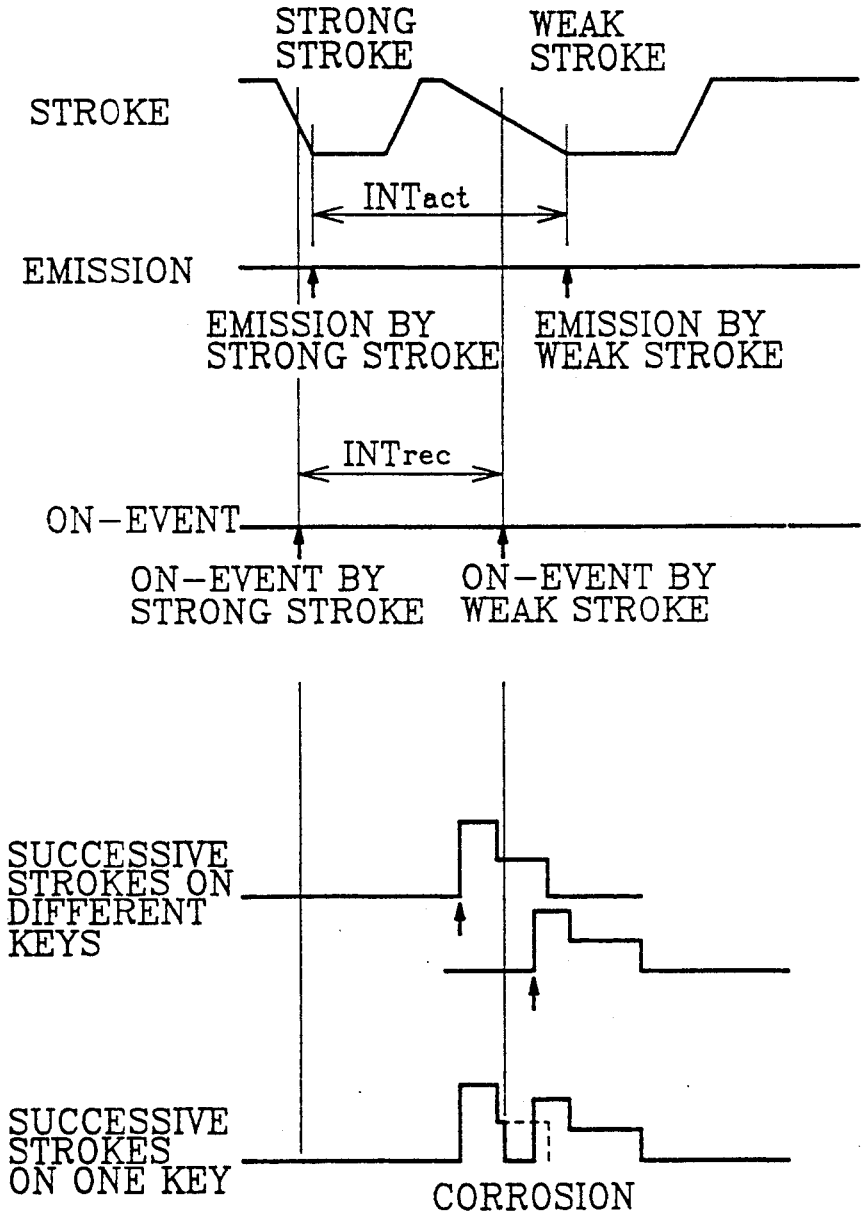
FIG. 13 is a timing diagram showing the problems inherent in the prior art reproducing method.

In the prior art device and method, in comparison, with the delay or sound prohibited time period provided intermediate or between an on-event command and excitation of solenoids, occurrence of an on-event does not immediately trigger the actuation of the key solenoids. In case of successive strokes on the same key (hora staccato for example), the time period to maintain the holding voltage level $L_3$ for the former strong key stroke is often corroded and shortened by the sound prohibited time period for the latter weak key stroke as shown in FIG. 13. The sound prohibited time period is thus detrimental to a precisely balanced reproduction of performance, occasionally resulting in failure to emit the sound for the former strong key stroke.

In the reproduction method according to this invention, however, solenoids are driven or terminated in immediate response to an on-event or an off-event, respectively. Since the on-event and off-event commands are provided according to emission timing and cessation timing in reproduction, respectively, corrosion or cut-off of the time period of sound emission for the former strong key stroke is successfully prevented.

This invention has been described above with reference to a preferred embodiment as shown in the drawings. Modifications and alterations may become apparent to one skilled in the art upon reading and understanding the specification. Despite the use of the embodiment for illustration purposes, it is intended to include all such modifications and alterations within the scope and the spirit of the appended claims.

In this spirit, it should also be noted that in the embodiments as shown and described, the recording method of this invention is accompanied by the reproducing method of this invention, however, either the recording method or the reproducing method can be independently adopted. Moreover, the recording delay data $TD_{rec}$ and the reproduction delay data $TD_{play}$ for matching emission timing with cessation timing may be a negative value. In this case, the predetermined value $\Delta TD$ is added, and not subtracted.

Wherefore, having described the present invention, what is claimed is:

1. A recording method for an automatic performing piano, comprising the steps of:

formulating key depression data and key release data by detecting depression and release of a key and by detecting key depression intensity; and sequentially storing, as performance information, said key depression data and said key release data, in sequence according to the occurrence of a key depression and a key release;

wherein said recording method further comprises the improvements of:

calculating a time period of delay in recording according to said key depression data, prior to said step of sequentially storing said key depression data as performance information, said time period of delay in recording corresponding to a time lag between depression of a key and emission of sound, said time lag varying according to the depression intensity of a depressed key, executing said step of sequentially storing said key depression data as performance information when the duration of said time period of delay in recording expires.

2. The method of claim 1 wherein said recording method further comprises the step of determining said time period of delay in recording such that the larger the depression intensity is, the shorter said time period of delay in recording.

3. The method of claim 1, wherein said recording method further comprises the improvement of:

calculating a time period of delay in recording according to said key release data, prior to said step of sequentially storing said key release data as performance information, said time period of delay in recording corresponding to a time lag between release of a key and cessation of sound, and executing said step of sequentially storing said key release data as performance information when the duration of said time period of delay in recording expires.

4. The method of claim 1 wherein the time period of delay in recording corresponds to a time period from a time when an on-event is detected by sensors and a time when a hammer strikes a string.

5. A reproducing method for an automatic performing piano, said piano including a storing means which stores key depression data and key release data, and a plurality of piano key drive solenoids, said method comprising the steps of:

reading out said key depression data and key release data from said storing means in sequence to generate performance;

temporarily storing said key depression data and key release data; and activating said key drive solenoids by a value of electric power determined according to key depression intensity included in said key depression data;

wherein said method further comprises the improvements of:

calculating, prior to said step of activating, a time period of delay in reproduction according to a time lag between the time to start the activation of said solenoid and emission of sound in reproduction, said time lag varying according to the depression intensity in said key depression data; and executing said step of activating said key drive solenoids immediately when the duration of said time period of delay in reproduction expires.

6. The method of claim 5, wherein said reproducing method further comprises the step of determining said time period of delay in reproduction such that the larger the depression intensity is, the longer said time period of delay in reproduction.

7. The method of claim 5, wherein said reproducing method further comprises the improvements of:

calculating a time period of delay in reproduction according to a time lag between release of a key and cessation of sound in reproduction, and terminating the activation of said key drive solenoids immediately when the duration of said time period of delay in reproduction expires.

8. The method of claim 5, wherein the time of delay in reproduction corresponds to a time period from a time when an instruction to strike a string is generated and a time when a hammer strikes a string.

9. A recording device for an automatic performing piano, comprising:

performance information storing means, for storing as performance information, key depression data and key release data in sequence according to a performance;

key depression and release timing detection means, for detecting the timing of depression and release of a key by detecting the distance and velocity of key travel;

key depression intensity calculation means, for calculating the intensity of a key depression according to the travel velocity of a depressed key;

performance information formulation means, for formulating performance information to be supplied to said performance information storing means in sequence according to said performance, said performance information comprising timing of key depression and key release, and key depression intensity;

wherein said recording device further comprises:

incorporation means, for incorporating a time period of delay in recording into said key depression data according to said calculated key depression intensity, said time period of delay in recording corresponding to a time lag between depression of a key and emission of sound during recording;

temporary storing means, for temporarily storing said key depression data incorporating said time period of delay in recording; and timing means, for providing said key depression data stored within said first temporary storing means to said performance information storing means when said time period of delay in recording expires.

10. The device of claim 9, wherein said time period of delay in recording is determined such that the larger the intensity of a depressed key is, the shorter said time period of delay in recording.

11. A reproducing device for an automatic performing piano, comprising:

performance information storing means, for storing as performance information, key depression data and key release data in sequence according to a performance, said key depression data including key depression intensity;

performance information output means, for outputting in sequence according to said performance, said key depression data and said key release data stored as performance information within said performance information storing means; and solenoid drive means, for energizing key drive solenoids, said key drive solenoids activated by a value of electric power determined according to said key depression intensity comprised in said key depression data, said activation of said key drive solenoids terminated in response to said key release data;

wherein said reproducing device further comprises:

incorporation means, for incorporating a time period of delay in reproduction into said key depression data received from said performance information storing means, said time period of delay in reproduction corresponding to a time lag between the time to start said activation of said key drive solenoids and emission of sound in reproduction, said time lag varying according to the depression intensity in said key depression data;

temporary storing means, for temporarily storing said key depression data incorporating said time period of delay in reproduction;

timing means, for providing said key depression data to said solenoid drive means when said time period of delay in reproduction expires.

12. The device of claim 11, wherein said time period of delay in reproduction is determined such that the larger the intensity of a depressed key is, the longer said time period of delay in reproduction.

13. An automatic performing piano comprising a recording device comprising:

performance information storing means, for storing as performance information, key depression data and key release data in sequence according to a performance;

key depression and release timing detection means, for detecting the timing of depression and release of a key by detecting the distance and velocity of key travel;

key depression intensity calculation means, for calculating the intensity of a key depression according to the travel velocity of a depressed key;

performance information formulation means, for formulating performance information to be supplied to said performance information storing means in sequence according to said performance, said performance information comprising timing of key depression and key release, and key depression intensity;

wherein said recording device further comprises:

incorporation means, for incorporating a time period of delay in recording into said key depression data according to said calculated key depression intensity, said time period of delay in recording corresponding to a time lag between depression of a key and emission of sound during recording;

temporary storing means, for temporarily storing said key depression data incorporating said time period of delay in recording; and timing means, for providing said key depression data stored within said first temporary storing means to said performance information storing means when said time period of delay in recording expires; and a reproducing device comprising:

performance information storing means, for storing as performance information, key depression data and key release data in sequence according to a performance, said key depression data including key depression intensity;

performance information output means, for outputting in sequence according to said performance, said key depression data and said key release data stored as performance information within said performance information storing means; and solenoid drive means, for energizing key drive solenoids, said key drive solenoids activated by a value of electric power determined according to said key depression intensity comprised in said key depression data, said activation of said key drive solenoids terminated in response to said key release data;

wherein said reproducing device further comprises:

incorporation means, for incorporating a time period of delay in reproduction into said key depression data received from said performance information storing means, said time period of delay in reproduction corresponding to a time lag between the time to start said activation of said key drive solenoids and emission of sound in reproduction, said time lag varying according to the depression intensity in said key depression data;

temporary storing means, for temporarily storing said key depression data incorporating said time period of delay in reproduction;

timing means, for providing said key depression data to said solenoid drive means when said time period of delay in reproduction expires.

* * * * *